US005158737A

United States Patent [19]

Stein

[11] Patent Number: 5,158,737

[45] Date of Patent: Oct. 27, 1992

[54] APPARATUS FOR REFINING MOLTEN ALUMINUM

[75] Inventor: Andrew G. Stein, Fontana, Calif.

[73] Assignee: Altec Engineering, Inc., Fontana, Calif.

[21] Appl. No.: 692,697

[22] Filed: Apr. 29, 1991

[51] Int. Cl.[5] ..... C22B 9/05

[52] U.S. Cl. ..... 266/225; 266/235

[58] Field of Search ..... 266/225, 235; 75/680, 75/681

[56] References Cited

U.S. PATENT DOCUMENTS

| | | | |
|---|---|---|---|
| 3,227,547 | 1/1966 | Szekely | 266/235 |
| 3,743,263 | 7/1973 | Szekely | 266/225 |
| 4,021,026 | 5/1977 | Szekely | 266/275 |
| 4,040,610 | 8/1977 | Szekely | 266/235 |
| 4,203,581 | 5/1980 | Pelton | 266/217 |
| 4,372,541 | 2/1983 | Bocourt et al. | 75/680 |
| 4,867,422 | 9/1989 | Duenkelmann | 266/225 |

*Primary Examiner*—Melvyn J. Andrews

*Attorney, Agent, or Firm*—Harris, Kern, Wallen & Tinsley

[57] ABSTRACT

A gas distributor for an apparatus for refining molten metal, the distributor being positionable in a vessel with a heat source for heating the metal and inlets and outlets for metal and gases. The distributor includes a stationary unit and a rotating unit, with the rotating unit including a rotor carried on the lower end of a shaft rotatably positioned within the stationary unit, and with the stationary unit including a stator carried at the lower end of a sleeve, with the rotor having a frusto-conical upper surface and the stator having a mating frusto-conical lower surface with an outward gas flow path between the mating surfaces into the vessel. Also, a gas flow path is provided into the vessel downward from the lower end of the rotating unit. Further the stator and rotor have vanes at the outer surfaces thereof defining oblique channels which converge in the downward direction, with the rotor diameter preferably greater than the stator diameter.

4 Claims, 2 Drawing Sheets

FIG. 1
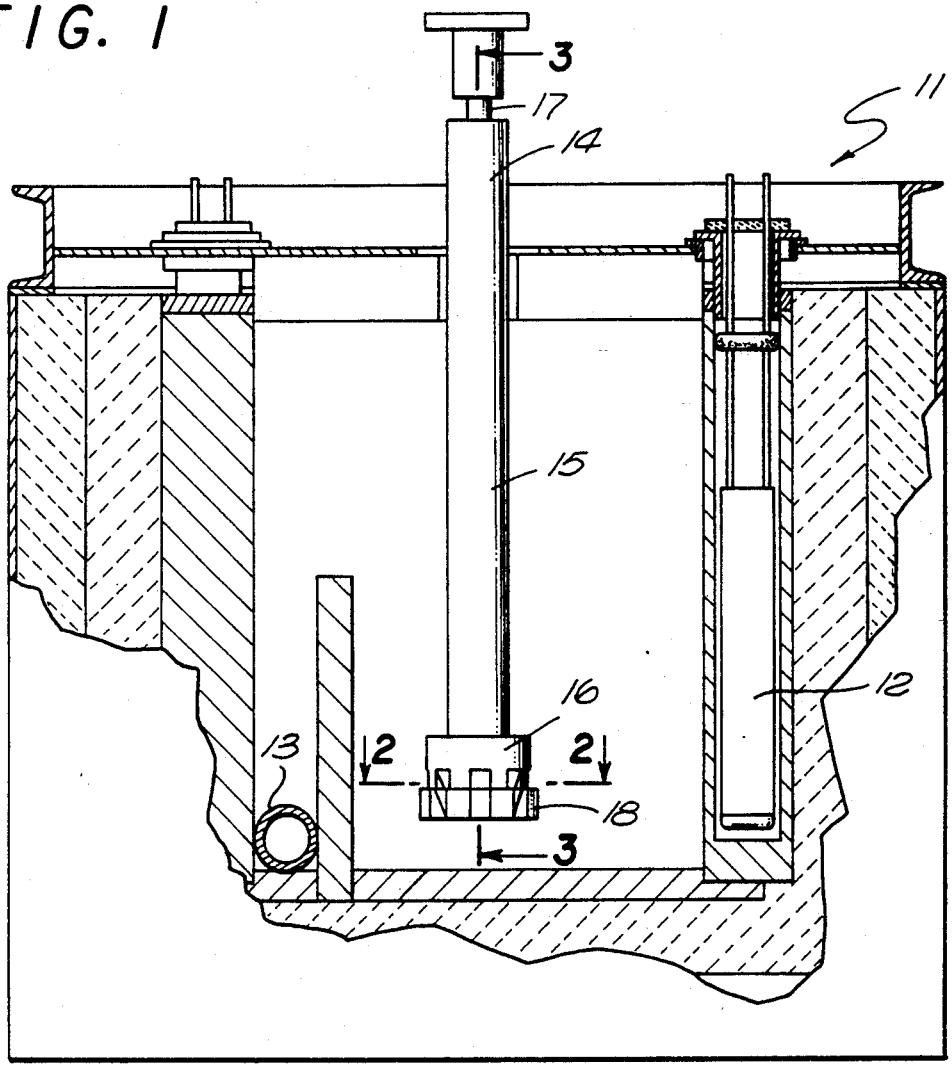
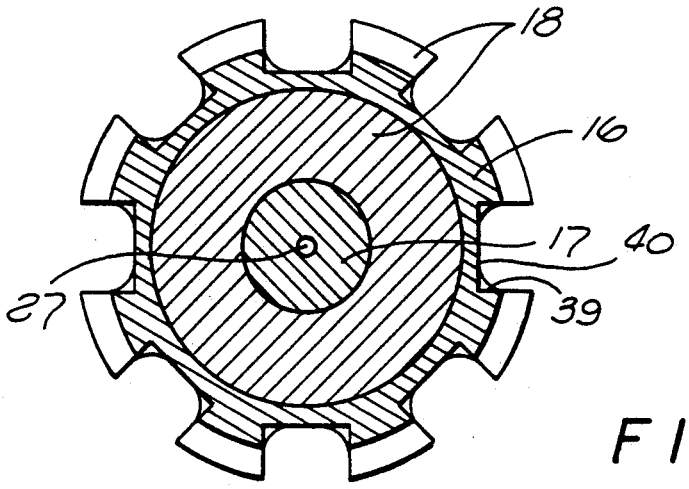
FIG. 2

APPARATUS FOR REFINING MOLTEN ALUMINUM

BACKGROUND OF THE INVENTION

This invention relates to an apparatus for refining molten metal, and in particular to a new and improved gas distributor for use in such apparatus.

The conventional apparatus for refining molten metal includes a vessel having a heat source, typically electrical resistance heating rods, for heating the metal, and arrangements for placing metal scraps in the vessel and withdrawing molten metal, and arrangements for introducing gas into the molten metal.

The basic concept and the operation of the metal refining apparatus is described in the U.S. Pat. Nos. to Szekely, 3,227,547; 3,743,263; 4,021,026; and 4,040,610.

Gas is pumped into the molten metal in the refining process, and various arrangments have been utilized for distributing the gas through the melt. One such arrangment is shown in the Szekely U.S. Pat. No. 3,743,263 with a rotor positioned below a stator, with the rotor and stator of the same outside diameter and having vanes which when aligned define vertical passages along the stator and rotor outer surfaces. Gas is introduced between the rotor and stator and is directed horizontally outward into the melt. The vaned rotor and stator provide for metal circulation within the melt and for gas distribution.

An alternative configuration for the gas distributor is shown in the U.S. Pat. No. to Pelton, 4,203,581. In this distributor, the stator is smooth and the rotor is vaned, with the rotor extending beyond the stator and with the root diameter of the rotor about the same as the diameter of the stator.

Other variations of the stator-rotor configuration are shown in the aforementioned U.S. Pat. No. to Szekely, 3,227,547 and in the U.S. Pat. No. to Duenkelmann, 4,867,422.

Improved and more efficient refining of the molten metal can be achieved with more uniform and more rapid distribution of the gas throughout the melt. Older designs require a tight control on rotating speed and gap between the stator and impellor in order to maximize shearing of bubbles.

SUMMARY OF THE INVENTION

It is an object of the present invention to provide a new and improved gas distributor suitable for use in metal refining vessels. It is a particular object of the invention to provide a new stator and rotor configuration which provide for a downward flow of gas bubbles into the melt in a connical pattern which pattern expands in a downward direction. A further object is to provide such a construction with oblique channels in the stator and rotor with the channels converging at a downward direction. An additional object is to provide such a construction which also utilizes an actual downward gas flow pattern.

The presently preferred embodiment of the gas distributor of the invention is positionable in a vessel having means for heating the metal and inlet and outlet means for molten metal and gases. The distributor includes a stationary unit and a rotating unit, with the rotating unit including a rotor carried on the lower end of a shaft rotatably positioned within the stationary unit, and with the stationary unit including a stator carried at the lower end of a sleeve, and with means for gas flow downward to the stator and rotor. The rotor has a frusto-conical upper surface and the stator has a mating frusto-conical lower surface with an outward gas flow path between the mating surfaces into the vessel.

The preferred embodiment also includes a second gas flow path into the vessel downward from the lower end of the rotating unit. Further the stator and rotor have vanes at the outer surfaces thereof defining oblique channels which converge in the downward direction, with the rotor diameter preferably greater than the stator diameter.

BRIEF DESCRIPTION OF THE DRAWINGS

FIG. 1 is a side view, partially broken away, showing the presently preferred embodiment of the gas distributor of the invention installed in a metal refining vessel;

FIG. 2 is an enlarged sectional view taken along the line 2—2 of FIG. 1;

DESCRIPTION OF THE PREFERRED EMBODIMENT

Figure 3:
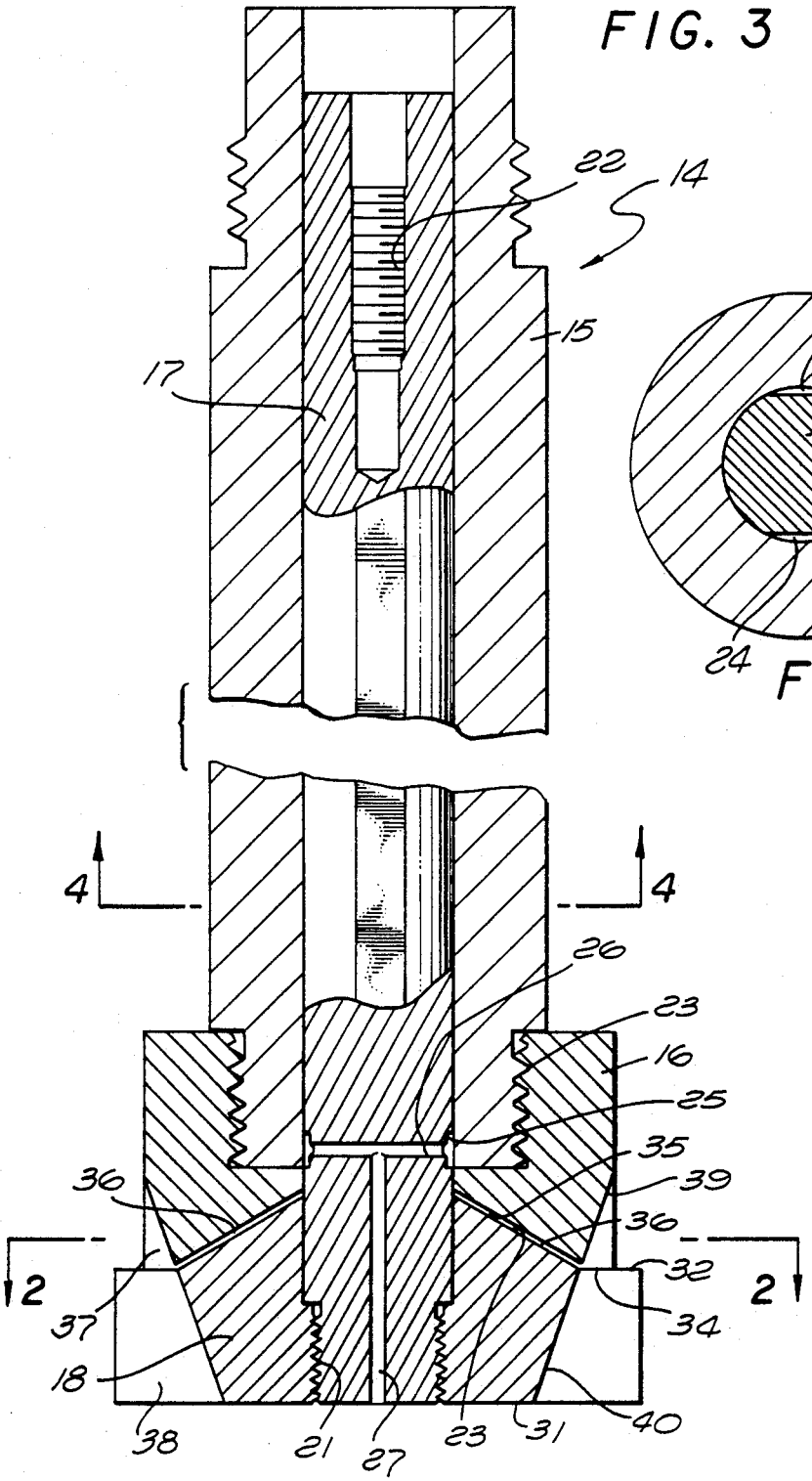
FIG. 3 is an enlarged sectional view taken along the line 3—3 of FIG. 1.
Figure 4:
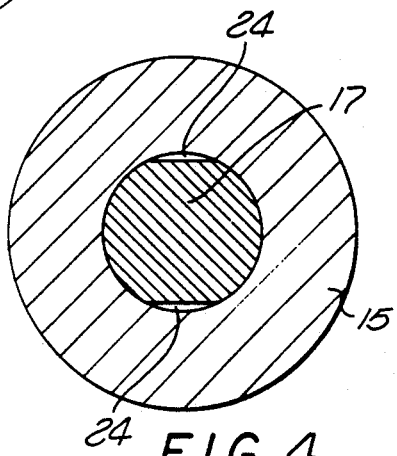
FIG. 4 is a sectional view taken along the line 4—4 of FIG. 3.

A conventional vessel 11 for molten metal refining is shown in FIG. 1. One or more electrical resistance heaters 12 are positioned within the vessel, which also has an outlet line 13 for removing molten metal. A gas distributor 14 is positioned in the vessel and includes a stationary unit with a sleeve 15 and a stator 16 at the lower end of the sleeve, and a rotating unit with a shaft 17 positioned in the sleeve 15 with a rotor 18 at the lower end of the shaft. The shaft is driven by a motor or other drive device (not shown) coupled at the upper end of the shaft. A source of gas under pressure (not shown) is connected at the upper end of the distributor for gas flow downward into the melt. Solid metal is introduced at the top of the vessel, and gas from the melt escapes at the vessel top. The construction as desribed above is standard and is widely used in the metal refining industry.

The rotor 18 is threaded onto the lower end of the shaft 17 at a threaded joint 21. A threaded opening 22 is provided at the upper end in the shaft 17 for connection with the drive mechanism. The stator 16 is threaded onto the lower end of the sleeve 15 at a threaded connection 23. Means are provided for gas flow downward from the upper end of the distributor to the lower end. In the embodiment illustrated, flats 24 are provided on the shaft 17 so that the gas can flow downward between the shaft and sleeve while the shaft is rotating in the sleeve. An annular groove 25 and a transverse or diametrical passage 26 are provided adjacent the lower end of the shaft to provide for gas flow from the upper end of the distributor to the lower end thereof past the flats, through the annular groove 25 and the passage 26 and downward through an outlet passage 27, which tyically is coaxial with the shaft. The flats 24 on the shaft 17 may terminate at the flow path 36 between the stator and the rotor, but preferably are continued through to the threaded section 21 for ease of manufacture.

In the preferred embodiment illustrated, the rotor 18 has a generally cylindrical shape, with a flat lower surface 31 and with the upper surface having an outer flat portion 32 and inner portion 33 of a frusto-conical shape. The stator 16 has a lower surface with an outer flat portion 34 and an inner portion 35 of a frusto-conical shape which mates with the portion 33 of the rotor. The mating frusto-conical surfaces are spaced apart a bit, typically 0.125 inches, to provide an outward gas flow path 36 from the shaft into the melt.

The stator and rotor have vanes 37, 38, respectively, at the outer surfaces. The vanes are cut so that the stator and rotor vanes, when aligned as shown in FIGS. 2 and 3, define oblique channels 39, 40 that converge toward each other in a downward direction.

The outside diameter of the rotor is made greater than the outside diameter of the stator, and the preferred ratio of rotor outside diameter to stator outside diameter is in the range of about 1.1 to about 1.3. The presently preferred outside rotor diameter is 8 inches and the presently preferred stator outside diameter is 7 inches, giving a rotor to stator ratio of 1.14.

In operation, the shaft 17 is driven to rotate the rotor 18 relative to the stator 16 in the melt. Typical rotating speeds are in the range of 300 to 500 rpm. A source of gas under pressure, typically argon, nitrogen, chlorine, Freon and combinations thereof, is provided at the upper end of the distributor and flows downward around the shaft and outward into the melt through the flow path 36 and the outlet passage 27. The gas bubbles moving outward through the flow path 36 are alternately directed outward and upward when impinging on the outer flat upper portion 32 of the rotor and outward and downward when passing through the channels 40 of the rotor. The improved design of the invention provides for discharge of gas over a broader portion of the melt, including that around and above the rotor, that around and below the rotor and that directly below the rotor. Also, the vanes of the rotor passing the vanes of the stator provide stirring in the melt for better mixing of the gas in the melt, with the oblique channel configuration providing for increased mixing in the lower portion of the melt. The movement of the vanes of the rotor past the vanes of the stator provides a shearing action which disperses gas into a very fine effervescence which helps maximize refining and minimize oxide carry over.

I claim:

1. A gas distributor for an apparatus for refining molten metal, said distributor being positionable in a vessel having a bottom, means for heating the metal and inlet and outlet means for metal and gases, said distributor having a lower end for positioning in the molten metal in the vessel spaced from the bottom of the vessel, and an upper end for projecting upward out of the molten metal, said distributor including a stationary unit and a rotating unit, with said rotating unit including a shaft having an upper end and a lower end and a rotor carried on said lower end of said shaft, said rotor having an outside diameter, and with said stationary unit including a sleeve having an upper end and a lower end and a stator carried at said lower end of said sleeve, said stator having an outside diameter, with said shaft rotatably positioned within said sleeve with said rotor below said stator defining a first gas flow path between said stator and rotor, and with said distributor including means for gas flow downward toward said lower end thereof to said first gas flow space between said stator and rotor, said rotor having a frusto-conical upper surface and said stator having a mating frusto-conical lower surface with said first gas flow path between said mating surfaces into said vessel, said rotating unit including means defining a second gas flow path from the lower end of said rotating unit into said vessel, said stator having vanes between said lower surface and outside diameter thereof, and said rotor having vanes between said upper surface and outside diameter thereof, with said stator and rotor vanes when aligned defining oblique channels which converge toward each other in a downward direction toward said distributor lower end.

2. A gas distributor as defined in claim 1 wherein said rotor outside diameter is greater than said stator outside diameter.

3. A gas distributor as defined in claim 1 wherein the ratio of the rotor outside diameter to the stator outside diameter is in the range of about 1.1 to 1.3.

4. A gas distributor as defined in claim 1 wherein said means for gas flow to said stator and rotor includes, first means defining a third annular flow path between said shaft and said sleeve to said first flow path, and second means defining a fourth transverse flow path between said third annular flow path and said second flow path.

* * * * *